United States Patent [19]

Ritchey et al.

[11] Patent Number: 5,067,174

[45] Date of Patent: Nov. 26, 1991

[54] PROTECTIVE HEADGEAR

[76] Inventors: Albert E. Ritchey, 2109 Cloud Croft Cir., Birmingham, Ala. 35216; Thomas C. Reeves, 3501 Mountain La., Birmingham, Ala. 35213

[21] Appl. No.: 576,963

[22] Filed: Sep. 4, 1990

Related U.S. Application Data

[63] Continuation-in-part of Ser. No. 356,447, May 24, 1989.

[51] Int. Cl.[5] ..... A42B 1/06

[52] U.S. Cl. ..... 2/10; 2/9; 2/13; 2/171; 2/173; 2/185 R; 2/199; 128/206.19; 128/201.17; 128/201.24

[58] Field of Search ..... 2/9, 10, 11, 13, 173, 2/174, 185 R, 199, 202, 206, 171; 128/201.12, 201.13, 201.17, 206.23, 207.11, 201.22, 201.23, 201.24, 201.25, 201.27, 206.12, 857, 863, 917, DIG. 15

[56] References Cited

U.S. PATENT DOCUMENTS

| | | | |
|---|---|---|---|
| 152,215 | 6/1874 | Grufutt | 128/206.19 |
| 413,424 | 10/1889 | Weber | 2/10 |
| 772,273 | 10/1904 | Braverman | 2/206 |
| 1,251,657 | 1/1918 | Hart | 2/10 |
| 1,313,745 | 8/1919 | Schwartz | 128/207.11 |
| 1,923,340 | 8/1933 | Steckler | 2/174 |
| 2,056,753 | 10/1936 | Wagner | 128/206.19 |
| 2,179,719 | 11/1939 | Goskey | 2/10 |
| 3,113,321 | 12/1963 | Siegel | 2/174 |
| 3,885,558 | 5/1975 | Belkin | 2/173 X |
| 3,943,575 | 3/1976 | Bolker | 2/DIG. 7 X |
| 4,014,047 | 3/1977 | Zobel | 128/206.19 |
| 4,032,991 | 7/1977 | Vandeweghe | 2/173 X |
| 4,250,577 | 2/1981 | Smith | 2/427 |
| 4,312,338 | 1/1982 | Glassman | 128/201.22 |
| 4,387,471 | 6/1983 | Hsu et al. | 2/10 |
| 4,464,797 | 8/1984 | Glassman | 2/199 |
| 4,583,535 | 4/1986 | Saffo | 2/206 X |
| 4,747,164 | 5/1988 | Foulke | 2/200 X |
| 4,796,621 | 1/1989 | Barle et al. | 128/206.23 |
| 4,811,430 | 3/1989 | Janusz | 2/171 |
| 4,850,049 | 8/1988 | Landis | 2/10 |
| 4,852,562 | 8/1989 | Howie | 128/201.22 |
| 4,873,726 | 10/1989 | Tapia | 2/10 X |

FOREIGN PATENT DOCUMENTS

| | | | |
|---|---|---|---|
| 0316291 | 5/1989 | European Pat. Off. | 2/9 |
| 1461589 | 11/1966 | France | 128/DIG. 15 |
| 117209 | 7/1969 | Norway | 2/173 |
| 8910106 | 11/1989 | World Int. Prop. O. | 128/206.12 |

*Primary Examiner*—Werner H. Schroeder
*Assistant Examiner*—Jeanette E. Chapman
*Attorney, Agent, or Firm*—Jennings, Carter, Thompson & Veal

[57] ABSTRACT

A headdress for wear by a health care professional or other person who is likely to come in contact with contaminants provides easily placeable and removable covering for the entire head area through the use of a unitized structure incorporating a headgear, a visor covering and shielding the eyes, and a face mask attached to the lower portion of the visor. The entire unit may be removed with one hand and may be discarded without further contamination.

10 Claims, 2 Drawing Sheets

Fig. 1
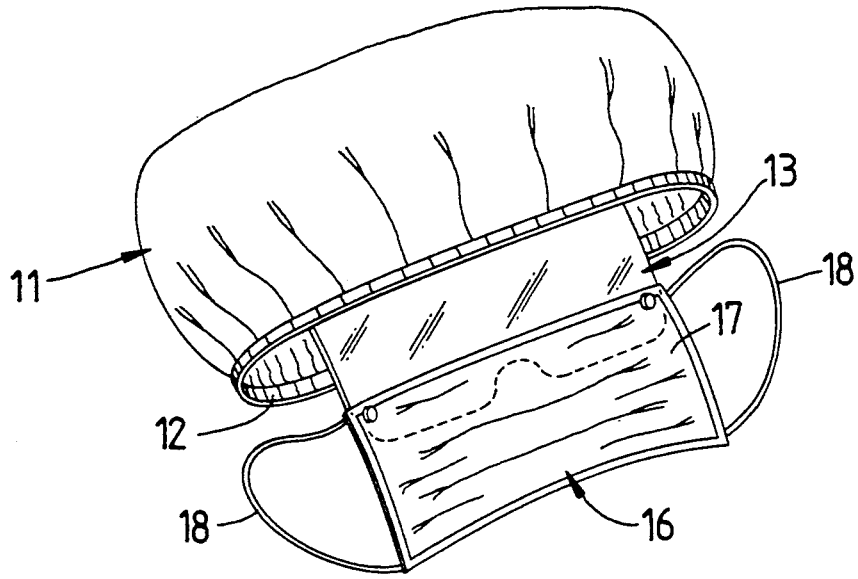
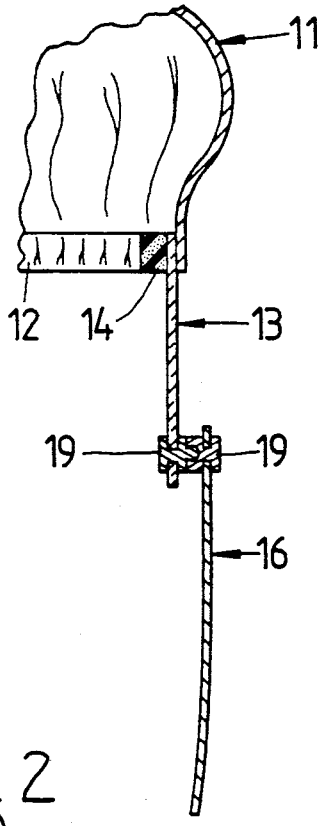
Fig. 2
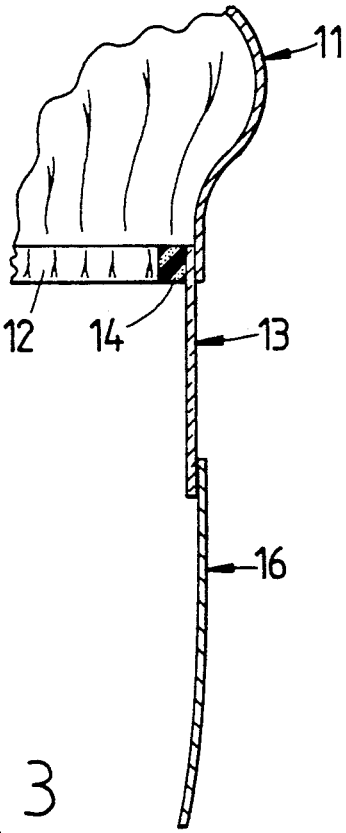
Fig. 3

PROTECTIVE HEADGEAR

This is a continuation-in-part of application Ser. No. 07/356,447 filed May 24, 1989.

FIELD OF THE INVENTION

The present invention relates to protective garments worn by health care professionals or other professionals who are likely to come in contact with contamination or hazardous materials which may be easily secured to the head of the wearer. More particularly the present invention relates to a unitary head covering, eye shield and face mask which may be utilized by health professionals or other such persons in the proximity of a hazardous substance. In even greater particularity the present invention relates to a unitized head covering, eye shield and face mask which may be easily placed on the user's head and then easily removed such that contamination of the user is not furthered by the use of the apparatus.

BACKGROUND OF THE INVENTION

The rapid spread of highly hazardous contaminants such as blood specimens and bodily fluids from AIDS victims and the like has led to increased precautionary measures being taken by health care professionals to avoid contact with such bodily fluids. For example, health care professionals now are wearing latex gloves to shield them against contamination with body fluids in dentist's offices, in nursing facilities, and in laboratories. Furthermore, certain health care professionals are wearing clothing which may be easily removed and disposed of when working in quarantined or contaminated areas, for example masks have been devised which are disposable and outer garments commonly referred to as scrubs have been devised which are easily removed without spreading any contaminant which may be present on the clothing. One problem which has not been addressed by such clothing is that oftentimes an emergency room personnel or other care provider is brought into contact with a patient on very short notice. Thus, one does not always have time to don all the protective clothing which one would desire to wear in such a situation. Therefore, it is necessary to provide clothing which may be easily positioned on the wearer as well as easily removed. Prior to the present invention, the utilization of a head net was largely optional. More particularly, people were concerned with face masks, thus the standard mask which tied behind the head has long been accepted as medical practice for the health care professional. Also the standard mask with an elastic strap which goes about the back of the head has also been accepted. Recently, an innovation has occurred which has combined the flexible, disposable face mask with a clear acrylic or plastic eye shield such that the area of the health care provider's eyes is not exposed to contamination. It is therefore apparent that the face of the health care provider would be shielded from contamination by the mask over the mouth and the shield over the eyes. Although this development is a welcome improvement over having merely a face mask which will protect against certain contaminants, it is lacking in that the eye shield is not always properly positioned and is susceptible to being bent away from the face of the user and there is no protection laterally of the eye shield or above the eye shield.

SUMMARY OF THE INVENTION

It is the object of the present invention to provide a garment of protective clothing which may be easily worn by a health care professional in a hazardous situation.

Yet another object of the present invention is to provide a health care professional with a garment which will cover both the top of the head, the rear and sides of the head as well as shield the eyes and provide a face mask.

Yet another object of the present invention is to prevent the spread of contagious disease through the contamination of health care providers and other personnel who are unexpectedly brought into contact with a contagious person or contaminated substance.

BRIEF DESCRIPTION OF THE DRAWINGS

Apparatus embodying features of my invention are depicted in the accompanying drawings which form a portion of this disclosure and wherein:

FIG. 1 is a perspective view of my invention showing the head covering, eye shield and face mask in cooperation:

FIG. 2 is a sectional view taken along the vertical axis of the front of my apparatus showing in section the head covering, the shield and the face mask in a first embodiment;

FIG. 3 is also a sectional view as in FIG. 2 of a second embodiment.

DESCRIPTION OF A PREFERRED EMBODIMENT

Figure 4:
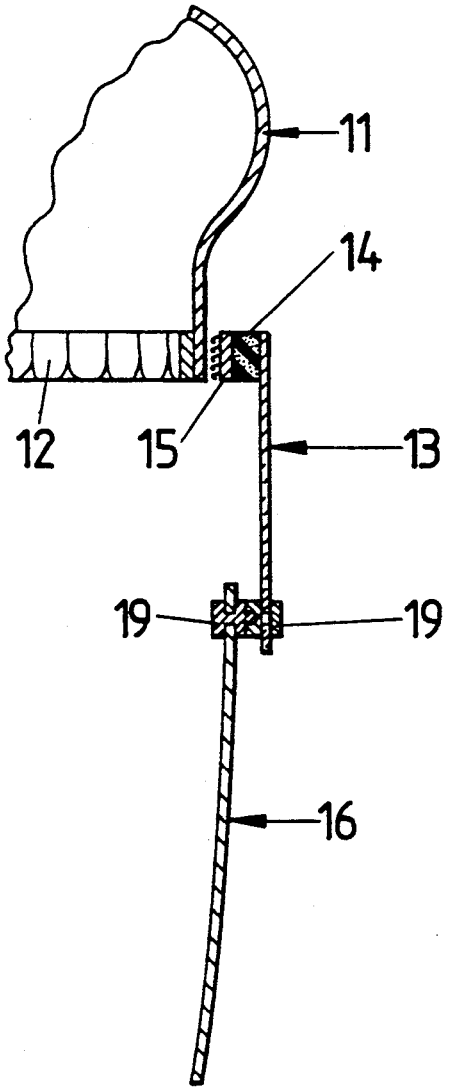
FIG. 4 is also a sectional view as in FIG. 2 of a third embodiment.

Referring to FIG. 1, it may be seen that my protective apparatus includes a head covering 11 such as an envelope means inclusive of a bouffant cap which has an elastic band 12 sewn about the opening thereof and which extends over the entire top of the user's head including substantially all of the hair. The head covering is a lightweight material such as non-woven spun polypropylene as may be commonly used for such head coverings in medical health care currently that is disposable and essentially has the shape of a bubble. Attached to what is determined to be the front of the head covering 11 is a clear plastic visor 13 which is either glued or sewn to the head covering 11 such that the head covering and the visor are securely attached one to another. As viewed in FIG. 4, the visor 13 may also be attached to the outer perimeter of the head cover 11 by an adhesive strip 15 continually reusable in application, preferably utilizing a plurality of hook-like projections as found in hook and pile fasteners but not limited thereto. The adhesive strip 15 is permanently connected to the felt pad 14 which extends across the upper length of the visor 13. The adhesive strip 15 allows the visor 13 to be disconnected from the head covering 11, further encouraging the process of easy removal of the protective headgear without contamination of the wearer. The visor extends from the elastic band 12 of the head covering 11 down to the bridge of the nose and onto the cheek area of a wearer. It is preferentially made with an anti-fog coating on one side such that water vapor expelled during the breathing of the wearer will not fog the visor. Attached to the visor and extending across the upper length thereof, as shown in FIGS. 2 and 3, is a felt pad 14 which may be attached to the visor with an adhesive or may also be sewn to the visor such that the visor does not present a sharp edge or an uncomfortable region along the user's forehead when the apparatus is in use. The visor may have a lower notched portion removed to allow the user's nose to fit comfortably therein. Attached to the lower portion of the visor is a face mask 16 through which air may pass and which acts to screen the air as it does pass therethrough as is commonly known in the art. The face mask includes a permeable region 17 disposed across the face of the user from above the nose to below the chin and a pair of ear straps 18 which are elastic members which may be placed behind the ears of the user to hold the face mask in place. As will be noted in FIGS. 1 and 2, the face mask is attached to the visor by a pair of plastic snaps or rivets 19 which allow the visor and face mask to be easily fabricated or to be easily separated. In the alternative embodiment shown in FIG. 3, the visor 13 may be adhered or sewn or tacked directly to the face mask 16 or vice versa such that a permanent bonding is achieved and the apparatus is not readily separated.

It will be appreciated by health care professionals that our apparatus now provides an extremely convenient and useful manner of protecting oneself from an unknown hazard. As is well known in the prior art, one must first seek a head covering and place it on the head, then place a face mask on the face and then find a visor from a third source to allow one to provide full protection to the exposed areas about the head. As is well known in the prior art, these independent devices worked not in unison, but rather in disunity and oftentimes were interfering with one another in seeking a way to attach themselves to the user's head. The present apparatus overcomes all such difficulties and once the apparatus is placed on the head, no further adjustment of the lens or hat or mask will be necessitated by the conflict between the component parts for points of attachment in as much as they are all unitized in their attachment. The visor is held securely in place in front of the eyes by the combination action of the head covering and the face mask. Likewise, the head covering is unlikely to slip down over the eyes of the user in as much as it is partially supported in its position by the visor which is in turn supported by the face mask. Thus, it may be seen that although each component in the present invention is still able to function admirably in the manner intended in prior usage, these various components now combine to provide a unitized protective garment which is superior to any combination of separate protective articles which have been worn in the past.

While I have shown my invention in two forms, it will be obvious to those skilled in the art that it is not so limited but is susceptible of various changes and modifications without departing from the spirit thereof.

What we claim is:

1. Apparatus for providing a protective cover to the head of a health care professional or like user exposed to a contaminating environment comprising:

(a) a protective head covering means made from a spun polypropylene fabric having an elastomeric band encircling the head and circumscribing a singular opening in a protective covering such that the user's head is situated within the opening and covered above the elastomeric band means by the protective covering;

(b) A clear visor extending across the face of the user having a strip attached along an upper margin thereof made from a hooked portion of hook and loop material, wherein said strip detachably engages said polypropylene fabric in hook and loop relation being easily detached and reattached; and (c) a face mask attached to the visor at a lower periphery thereof and providing means for attachment of said face mask and said visor to the face of the user.

2. An article for protecting a wearer from contamination comprising, in combination:

(a) envelope means made from a spun polypropylene fabric for covering the head of a wearer including means circumscribing the head proximal the hair line of the head for securing said envelope means to said head, said securing means defining a singular opening in said envelope means;

(b) visor means having a strip made from the hook portion of hook and loop material attached along an upper margin thereof, said strip being detachably secured to said envelope means proximal said securing means with said visor extending downward to cover the portion of a wearer's face proximal the eyes without obstructing the wearer's vision; and (c) mask means secured to a lower margin of said visor means in downward extension therefrom for covering the portion of a wearer's face including the mouth and nostrils thereof.

3. An article as defined in claim 2 wherein said envelope means comprises:

(a) a bouffant cap made from a moisture barrier material which is flexible and gas permeable; and (b) an elastic band attached to said bouffant cap to serve as said securing means.

4. An article as defined in claim 3 wherein said visor means comprises a panel of a clear impermeable material having an upper margin of sufficient length to extend across the forehead of a wearer, with said strip being attached to said panel along said margin and said panel extending downwardly to below the eyes of the wearer.

5. An article as defined in claim 4 further comprising an elongated compressible pad affixed intermediate the upper margin and said strip.

6. An article as defined in claim 2 wherein said mask means comprises a flexible gas permeable panel extending from the nose of the wearer to below the chin of the wearer and having an elastic strap mounted on each side thereof which is adapted for placement behind the ears of the wearer to secure said mask means in place.

7. An article as defined in claim 2 wherein said visor means comprises a panel of a clear impermeable material having an upper margin of sufficient length to extend across the forehead of a wearer, with said strip being attached to said panel along said margin, and said panel extending downwardly to below the eyes of the wearer.

8. An article as defined in claim 7 further comprising an elongated compressible pad affixed intermediate the upper margin and said strip.

9. An article as defined in claim 8 wherein said mask means comprises a flexible gas permeable panel extending from the nose of the wearer to below the chin of the wearer and having an elastic strap mounted on each side thereof which is adapted for placement behind the ears of the wearer to secure said mask means in place.

10. An article as defined in claim 2 wherein said mask means comprises a flexible gas permeable panel extending from the nose of the wearer to below the chin of the wearer and having an elastic strap mounted on each side thereof which is adapted for placement behind the ears of the wearer to secure said mask means in place.

* * * * *